US009638077B2

(12) United States Patent
Hörr

(10) Patent No.: US 9,638,077 B2
(45) Date of Patent: May 2, 2017

(54) MUFFLER

(71) Applicant: Eberspächer Exhaust Technology GmbH & Co. KG, Neunkirchen (DE)

(72) Inventor: Micha Hörr, Schorndorf (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 15/219,635

(22) Filed: Jul. 26, 2016

(65) Prior Publication Data

US 2016/0333756 A1 Nov. 17, 2016

Related U.S. Application Data

(62) Division of application No. 14/730,618, filed on Jun. 4, 2015, now Pat. No. 9,429,052.

(30) Foreign Application Priority Data

Jun. 4, 2014 (DE) ..... 10 2014 107 907

(51) Int. Cl.
*F01N 1/02* (2006.01)
*F01N 1/08* (2006.01)
(Continued)

(52) U.S. Cl.
CPC ..... *F01N 1/166* (2013.01); *F01N 1/023* (2013.01); *F01N 1/163* (2013.01);
(Continued)

(58) Field of Classification Search
CPC ..... F01N 2470/02; F01N 2470/14; F01N 2470/18; F01N 2470/24; F01N 1/166;
(Continued)

(56) References Cited

U.S. PATENT DOCUMENTS 2,112,964 A 4/1938 Mackenzie
2,834,427 A * 5/1958 Powers ..... F01N 13/14 181/243

(Continued)

FOREIGN PATENT DOCUMENTS

DE 20 30 114 A1 1/1971
DE 10 2008 062 014 A1 6/2010

(Continued)

*Primary Examiner* — Edgardo San Martin
(74) *Attorney, Agent, or Firm* — McGlew & Tuttle, P.C.

(57) ABSTRACT

A muffler (1) for an exhaust system of a vehicle driven by an internal combustion engine, includes a gas-tight housing (2), a partition wall (31) inside the housing, an inlet pipe (51), a first outlet pipe (61), a switchable second outlet pipe (7) and a resonator pipe (8). The a partition wall (31) divides the housing's interior into a first volume (41) and a second separate volume (42). The inlet pipe and the first outlet pipe (61) and the second outlet pipe and the resonator pipe are in fluid communication with the first volume. The resonator pipe provides fluid communication between the first volume and the second volume. The second outlet pipe passes through the second volume. The second outlet pipe is surrounded, in a circumferential direction, by the resonator pipe in a section in which the second outlet pipe penetrates the partition wall.

20 Claims, 5 Drawing Sheets

(51) Int. Cl.
*F01N 1/16* (2006.01)
*F01N 1/00* (2006.01)

(52) U.S. Cl.
CPC ..... *F01N 2240/36* (2013.01); *F01N 2470/02* (2013.01); *F01N 2470/14* (2013.01); *F01N 2470/18* (2013.01); *F01N 2470/24* (2013.01); *F01N 2490/15* (2013.01)

(58) Field of Classification Search
CPC ..... F01N 1/163; F01N 1/023; F01N 2240/36; F01N 2490/02; F01N 2490/15
USPC ..... 181/238, 239, 254, 237, 272, 275
See application file for complete search history.

(56) References Cited

U.S. PATENT DOCUMENTS 2,985,252 A * 5/1961 Morrish ..... F01N 1/02 181/239
3,070,187 A * 12/1962 Deremer ..... F01N 1/006 181/238
3,613,830 A 10/1971 Hubbell, III
4,501,341 A 2/1985 Jones
4,840,030 A * 6/1989 Ikeda ..... F01N 1/166 181/228
5,602,368 A 2/1997 Kaneso
5,614,699 A * 3/1997 Yashiro ..... F01N 1/02 181/254
5,692,374 A * 12/1997 Seki ..... F01N 1/02 60/312
5,708,237 A * 1/1998 Maeda ..... F01N 1/02 181/254
5,712,454 A * 1/1998 Ozawa ..... F01N 1/084 181/226
5,723,827 A * 3/1998 Sasaki ..... F01N 1/02 181/237
5,739,483 A * 4/1998 Yashiro ..... F01N 1/02 181/254
5,744,762 A * 4/1998 Seki ..... F01N 1/165 137/493
5,917,161 A * 6/1999 Fuhrmann ..... F01N 1/166 181/237
5,984,045 A * 11/1999 Maeda ..... F01N 1/02 181/254
6,912,843 B2 * 7/2005 Hufendiek ..... F01N 1/02 60/282
7,337,609 B2 * 3/2008 Mahnken ..... F01N 1/165 181/237
7,506,723 B2 * 3/2009 Hoerr ..... F01N 1/003 181/250
8,028,798 B2 * 10/2011 Koyanagi ..... F01N 1/003 181/212
8,468,813 B2 * 6/2013 Hill ..... F01N 1/006 181/237
8,607,923 B2 * 12/2013 Takagaki ..... F01N 1/02 181/227
9,429,052 B2 * 8/2016 Horr ..... F01N 1/166
2002/0005318 A1 * 1/2002 Schumacher ..... F01N 1/165 181/237
2007/0045043 A1 3/2007 Hoerr
2007/0125594 A1 6/2007 Hill
2011/0061969 A1 * 3/2011 Hill ..... F01N 1/006 181/239

FOREIGN PATENT DOCUMENTS

EP 1 760 279 B1 10/2010
JP S32-012227 10/1957
JP S54-008233 A 1/1979
JP S54 143941 U 10/1979
JP S61-126016 U 8/1986
JP S62-090915 U 6/1987
JP 63219809 A * 9/1988
JP H02-013124 U 1/1990
JP H02 13124 U 1/1990
JP H09-209739 A 8/1997
JP 2008-045495 A 2/2008
JP WO 2008150024 A1 * 12/2008 ..... F01N 1/084
JP 2009-519394 A 5/2009

* cited by examiner

MUFFLER

CROSS REFERENCE TO RELATED APPLICATIONS

This application is a divisional under 37 CFR 1.53(b) of pending prior application Ser. No. 14/730,618 filed Jun. 4, 2015, which claims the priority of German Patent Application 10 2014 107 907.8, filed Jun. 4, 2014. The entire contents of each application is hereby incorporated by reference in its entirety.

FIELD

The present invention relates to a switchable muffler for an exhaust system of a vehicle driven by an internal combustion engine.

BACKGROUND

Regardless of the type of internal combustion engine (for example reciprocating piston engine, pistonless rotary engine or free-piston engine), noise is generated as a result of the successively executed strokes (in particular intake and compression of the fuel-air mixture, combustion and discharge of the combusted fuel-air mixture). The noise propagates through the internal combustion engine in the form of solid-borne sound and is emitted on the outside of the internal combustion engine in the form of airborne sound. The noise also travels in the form of airborne sound together with the combusted fuel-air mixture through an exhaust system that is in fluid communication with the internal combustion engine. Due to this, also flow noise adds to the noise from the internal combustion engine. The noise traveling through the exhaust system is referred to as exhaust noise.

This noise is often regarded as being disadvantageous. There are statutory provisions on protection against noise to be observed by manufacturers of vehicles driven by internal combustion engines. These statutory provisions normally specify a maximum sound pressure for an operation of a vehicle. Further, manufacturers also try to impart a characteristic noise emission to internal combustion engine driven vehicles of their production, with the noise emission fitting the image of the respective manufacturer and being popular with customers. Present-day engines with small displacement often cannot naturally generate such intended characteristic noise.

The noise propagating through the internal combustion engine in the form of solid-borne sound can be muffled quite well and is thus usually no problem as far as protection against noise is concerned.

The noise traveling through the exhaust system of the internal combustion engine together with the combusted fuel-air mixture in the form of airborne sound is reduced by exhaust mufflers located ahead of the exhaust system discharge port and downstream of catalytic converters, if present. Respective mufflers may, for instance, work according to the absorption and/or reflection principle. Among others, resonance absorbers are used that operate according to the Helmholtz resonator principle.

A Helmholtz resonator consists of a body enclosing an air volume, the body comprising a resonator neck having an opening connecting the air volume with the surroundings. Due to the opening in the resonator neck, the air volume is not surrounded by the body completely, but can be considered divided into first and second sub-volumes of air. The first sub-volume of air is defined by the geometry of the resonator neck and extends from the opening in the resonator neck along the entire length of the resonator neck. The size of the first sub-volume of air thus depends on the cross section and the length of the resonator neck. The resonator neck's cross-section may either vary along the length of the resonator neck or remain constant. The resonator neck may further be straight-lined or curved. The second sub-volume of air adjoins the first sub-volume of air inside the body directly, the resonator neck thereby separating it from the body's opening. The second sub-volume of air being bigger than the first sub-volume of air is defined by the body's geometry exclusive of the resonator neck. At the transition between the first and the second sub-volumes of air, there may either be an opening in the body wall or the sign of the body wall's curvature will change, for example. The elasticity of the air volume inside the body combines with the inertial mass of the air present in the resonator neck to form a mechanical mass-spring system. Subject to the shape of the air volume, the mass-spring system has either one (for a spherical shape) resonance frequency (natural frequency) or a plurality (for shapes different to a sphere) of resonance frequencies (natural frequencies). The natural frequency depends inter alia on the size of the air volume enclosed, the cross-sectional area of the opening in the resonator neck, the length of the resonator neck, and a port adjustment factor depending on the ports shape and configuration (e.g. round, angular shaped, slit-like).

Both operating modes (absorption and/or reflection principle) suffer from lacking any adaptation to the frequency spectrum of a noise traveling through an exhaust system and changing with a changing speed of an internal combustion engine. An optimum noise muffling with conventional mufflers is therefore rarely achieved. The flow resistance for the exhaust traveling through the exhaust system presents a problem common to both operating modes. The noise muffling often is insufficient when designing the mufflers for the maximum exhaust gas stream at high speeds of the internal combustion engine. When designing the mufflers for an average exhaust gas stream at medium speeds of the internal combustion engine, a significant increase in the flow resistance and thus in the consumption of the internal combustion engine at higher engine speeds will be the consequence.

A muffler is known from the European patent EP 1 760 279 B1 wherein a switchable muffler pipe is acoustically coupled to a muffling system such that the muffling system is active, i.e. has its respective muffling effect, both for the open and the closed pipe but has a different muffling characteristic for the open pipe than for the closed pipe. With this design, the switchable pipe forms part of an effective muffling system also in its closed state, whereby the pipe changes its muffling characteristic when opened but still remains active.

Mufflers operating according to the Helmholtz resonator principle are known from U.S. Pat. No. 3,613,830, U.S. Pat. No. 4,501,341 and U.S. Pat. No. 5,602,368. Further mufflers are known from U.S. Pat. No. 2,112,964 and DE 10 2008 062 014 A1.

SUMMARY

Embodiments are directed to a switchable muffler for an exhaust system of a vehicle driven by an internal combustion engine comprising a Helmholtz resonator having a Helmholtz volume and a Helmholtz pipe, the Helmholtz resonator being switchable between at least two different resonance frequencies (natural frequencies).

Embodiments of a muffler for an exhaust system of a vehicle driven by an internal combustion engine comprise a gas-tight housing, at least one partition wall disposed inside the housing, at least one inlet pipe, at least one outlet pipe (first kind of outlet pipe), at least one preferably switchable second outlet pipe (second kind of outlet pipe), and at least one resonator pipe. The at least one partition wall divides the interior of the housing into a first volume and a second volume separate from the first volume. The at least one inlet pipe, as well as the at least one first outlet pipe, the at least one second outlet pipe, and the at least one resonator pipe, are in fluid communication with the first volume. The at least one resonator pipe is also in fluid communication with the second volume and thus altogether provides a fluid communication between the first and second volumes. The at least one second outlet pipe passes through the second volume and is, at least with a section where it penetrates the at least one partition wall, disposed inside the resonator pipe. In the section along the longitudinal direction of the at least one second outlet pipe where the second outlet pipe penetrates the at least one partition wall, the at least one resonator pipe accordingly surrounds the at least one second outlet pipe in a circumferential direction completely. Also, the at least one first outlet pipe may optionally penetrate the second volume and the at least one partition wall. The fluid communication between the first and second volumes is thus provided at least in a section by an annular clearance formed between the second outlet pipe and the resonator pipe. In case plural resonator pipes and second outlet pipes are present, each second outlet pipe may be surrounded by one resonator pipe in the section along the longitudinal direction of the at least one second outlet pipe where the second outlet pipe penetrates the at least one partition wall.

The term "penetrating the partition wall" hereby not only refers to the case where a pipe (for instance the at least one first outlet pipe, the second outlet pipe, or the resonator pipe) projects beyond the at least one partition wall into the first volume, but also to the case where a port of the pipe is aligned flush with the at least one partition wall and where the partition wall is furnished with a corresponding opening providing a fluid communication between the pipe and the first volume.

Regarding the second outlet pipe, the term "in the section along the longitudinal direction of the second outlet pipe where it penetrates the at least one partition wall" refers accordingly to an embodiment also in the case where the resonator pipe projects beyond the partition wall into the first volume, or where a port of the resonator pipe is flush with the first partition wall and where the partition wall is furnished with a corresponding opening providing a fluid communication between the resonator pipe and the first volume, and where a port of the second outlet pipe is disposed offset with respect to the partition wall towards the second volume and inside the resonator pipe. According to an alternative embodiment, the second outlet pipe projects beyond the partition wall into the first volume, or a port of the second outlet pipe is aligned flush with the first partition wall, and the partition wall is furnished with a corresponding opening providing a fluid communication between the second outlet pipe and the first volume. The second outlet pipe is then disposed inside the resonator pipe, at least in the area around the port of the second outlet pipe.

The fluid communications may thereby each be provided either directly, i.e. without flow through a further component (in particular a pipe or an opening formed in a partition wall), or indirectly, that is by a flow through a further component (in particular a pipe or an opening formed in a partition wall).

The term "gas-tight housing" explicitly includes a penetration of a housing's wall by the at least one inlet pipe, the at least one first outlet pipe, and the at least one second outlet pipe, whereby appropriate openings may be provided for this purpose in the wall of the housing. The at least one inlet pipe, the at least one first outlet pipe, and the at least one second outlet pipe are on these occasions sealed in the openings gas-tight against the wall of the housing. The first volume of the housing is thus accessible from outside directly via the at least one inlet pipe, the at least one first outlet pipe, and the second outlet pipe, while the second volume of the housing is accessible from outside indirectly via the first volume and the resonator pipe. It is thus possible to feed the first volume by the at least one inlet pipe with a fluid, and in particular exhaust gas, which is then discharged from the first volume and thereby from the housing via the at least one first outlet pipe and the second outlet pipe. Since the second volume is, except for the resonator pipe, closed, there is only little air exchange between the first and the second volume even when the first volume is charged with a fluid.

The size of the second volume provided inside the housing is constant and forms a Helmholtz volume. The resonator pipe, providing a fluid communication between the first volume and the second volume, forms a Helmholtz pipe. The resonance frequencies (natural frequencies) of the Helmholtz resonator thus formed by the second volume and the resonator pipe depend inter alia on the effective length of the resonator pipe forming the Helmholtz pipe.

By disposing a longitudinal section of the second outlet pipe inside the resonator pipe, it is, if the second outlet pipe and the resonator pipe are set up the right way, possible to modify the effective volume of the resonator pipe forming the Helmholtz pipe by connecting and disconnecting the second outlet pipe. The resonator pipe's effective volume is defined by the dimensions of the standing air column between the first and the second volume inside the housing. The dimensions of said standing air column may change in response to the second outlet pipe being connected or disconnected. The standing air column may thereby be disposed entirely or partly inside the resonator pipe, and may further comprise sections of the second outlet pipe between the first and second volume. "Connecting" hereby means that the second outlet pipe is open allowing fluid, and in particular exhaust gas, to pass through it, while "disconnecting" means that the second outlet pipe is closed preventing fluid, and in particular exhaust gas, from passing through it. This way, the Helmholtz resonator thus formed of the second volume and the resonator pipe can be switched between at least two different resonance frequencies (natural frequencies). Connecting or disconnecting the second outlet pipe also changes the muffler's flow resistance.

Consequently, the structure according to the present invention allows a simultaneous changing of the muffling characteristic by changing the resonance frequencies (natural frequencies) as well as the muffler's flow resistance by connecting and disconnecting the second outlet pipe. Accordingly, it is possible to adjust the muffler in terms of its muffling characteristics and at the same time in terms of its flow resistance with regard to two different operating conditions of an internal combustion engine. This enables a better noise muffling of the exhaust noise passing the muffler and a reduction in the internal combustion engine's fuel consumption.

In this context, the inlet pipe may be configured for a fluid communication with the internal combustion engine, and the first and second outlet pipes may be configured for a fluid communication with a tail pipe of an exhaust system. Alternatively, the inlet pipe may be configured for a fluid communication with a tail pipe of an exhaust system (as a result of which the inlet pipe takes on the function of an outlet pipe), and the first and second outlet pipes may be configured for a fluid communication with an internal combustion engine (as a result of which the first and second outlet pipes take on the function of inlet pipes).

According to first embodiments of the above muffler, the second outlet pipe is disposed inside the resonator pipe for a whole of the resonator pipe's length, and a wall of the second outlet pipe comprises openings in a section where it is surrounded by the resonator pipe. This section may be located entirely in the first volume, entirely in the second volume, or partly in the first and partly in the second volume. The second outlet pipe may hereby extend beyond the resonator pipe and into the first volume, or an port of the second outlet pipe may be flush with an port of the resonator pipe. When the second outlet pipe is disconnected (closed), an annular clearance between an inside wall of the resonator pipe and an outside wall of the second outlet pipe acts as Helmholtz pipe over the whole length of the resonator pipe. Furthermore, when the second outlet pipe is disconnected (closed), a further standing air column, which is in fluid communication with the second volume via the annular clearance between the resonator pipe and the second outlet pipe and the openings in the second outlet pipe, is located inside of the second outlet pipe between the first and second volumes so that even a section of the second outlet pipe acts as Helmholtz pipe. When the second outlet pipe is connected (open), a section of the resonator pipe extending from the end of the resonator pipe located in the second volume of the housing to that section of the second outlet pipe having the openings arranged therein forms the section acting primarily as Helmholtz pipe.

According to second embodiments of the above muffler, an inlet pipe and the second outlet pipe are formed integrally to form a single-piece pipe. A wall of the single-piece pipe further comprises openings in a section, where the single-piece pipe is located within the first volume and not inside (i.e. outside) the resonator pipe, and is thus not surrounded by the resonator pipe in a circumferential direction. A fluid, and in particular exhaust gas, may be supplied to the first volume through these openings. The wall of the single-piece pipe further also comprises openings in a second section, where the single-piece pipe is located within the resonator pipe and is thus surrounded by the resonator pipe in a circumferential direction. This second section may be disposed entirely in the first volume, entirely in the second volume, or partly in the first and partly in the second volumes. When the second outlet pipe is disconnected (closed), an annular clearance formed between an inside wall of the resonator pipe and an outside wall of the single-piece pipe acts as Helmholtz pipe over the entire length of the resonator pipe. Furthermore, a further standing air column is located inside the single-piece pipe between the first and second volumes when the second outlet pipe is disconnected (closed), with the standing air column being in fluid communication with the first and second volumes through the annular clearance between the resonator pipe and the single-piece pipe and the openings in the single-piece pipe, so that a section of the single-piece pipe also acts a Helmholtz pipe. When the second outlet pipe is connected (open), a section of the resonator pipe, extending from the resonator pipe's end located within the second volume of the housing to the second section of the second outlet pipe having the openings formed therein, acts primarily as Helmholtz pipe.

According to the first as well as according to the second embodiments, the resonator pipe may optionally comprise an end located inside the first volume and coupled to the second outlet pipe or the single-piece pipe in a gas-tight manner. The fluid communication between the first and second volumes is then only provided in one section through an annular clearance formed between the second outlet pipe or the single-piece pipe and the resonator pipe, and in another section through the openings in the second outlet pipe or the single-piece pipe and through the second outlet pipe or the single-piece pipe.

According to third embodiments of the above muffler, the resonator pipe comprises a first section, where the resonator pipe is located inside the first volume and stands clear of the second outlet pipe (the second outlet pipe is thus not surrounded by the resonator pipe in a circumferential direction), and a second section, where the resonator pipe accommodates the second outlet pipe. Accordingly, a port of the second outlet pipe is located within the resonator pipe and spaced from an end of the resonator pipe disposed inside the first volume of the housing, so that the second outlet pipe ends inside the resonator pipe. Obviously, the second section is then located along a flow of fluid, and in particular of exhaust gas, traveling, when the second outlet pipe is connected (open), through the second outlet pipe downstream of the first section. In other words, the second section is located closer to the second volume than the first section. The second section may hereby be located entirely within the first volume, entirely within the second volume, or partly in the first and second volumes. When the second outlet pipe is disconnected (closed), the resonator pipe acts as Helmholtz pipe over a whole length of the resonator pipe. In the second section of the resonator pipe, only the annular clearance formed between the resonator pipe and the second outlet pipe contributes to the standing air column between the first and second volume, whereas in the first section of the resonator pipe, the whole inner diameter of the resonator pipe adds to the standing air column between the first and second volumes. When the second outlet pipe is connected (open), a section of the resonator pipe extending from the resonator pipe's end located inside the second volume of the housing to the port of the second outlet pipe primarily acts as Helmholtz pipe.

According to third embodiments, a port of the inlet pipe may furthermore optionally be disposed inside the resonator pipe. Furthermore, also a wall of the resonator pipe may in a section, where the resonator pipe stands clear of the second outlet pipe, be devoid of openings. Alternatively or additionally, a wall of the resonator pipe may optionally have openings in a section where the resonator pipe stands clear of the second outlet pipe.

According to fourth embodiments of the above muffler, the resonator pipe and the inlet pipe are formed integrally to form a single-piece pipe. This single-piece pipe leads to the second volume. A wall of the single-piece pipe comprises openings in a first section, where the single-piece pipe passes through the first volume, the openings providing the fluid communication between the inlet pipe and the first volume. The single-piece pipe wall is devoid of openings in at least a second section where the single-piece pipe surrounds the second outlet pipe. The wall of the single-piece pipe optionally comprises openings at least in a third section, where the single-piece pipe surrounds the second outlet pipe. Obviously, the second section is then disposed along a flow of fluid, and in particular of exhaust gas, traveling through the single-piece pipe downstream of the first section.

According to the third and fourth embodiments, a wall of the second outlet pipe may have openings in a section where the resonator pipe surrounds the second outlet pipe.

Embodiments of the above muffler in accordance with the first to fourth embodiments optionally further comprise a flap disposed in the second outlet pipe inside or outside the muffler's housing, the flap configured to close the second outlet pipe upon selection. Further, an electric motor coupled to or adapted for being coupled to a controller, and in particular to an engine control unit, may optionally be provided for selectively opening and closing the flap. Opening and closing the flap may in particular be effected subject to speed or load of a vehicles internal combustion engine. As an alternative to using an electric motor, the flap may also be operated pneumatically or hydraulically, the flap being moved into an open position by application of, for instance, negative pressure. Alternatively, the flap may optionally be biased in a position, where it closes the second outlet pipe, for instance using a spring, with the bias force being chosen such that the flap is opened against the bias force when the pressure applied by the exhaust gas to the flap equals a predetermined value.

According to embodiments, an outside wall of the first outlet pipe is connected to the at least one partition wall in a gas-tight manner.

According to embodiments, an outside wall of the resonator pipe is connected to the at least one partition wall in a gas-tight manner.

According to embodiments, radial supports are disposed between an outside wall of the second outlet pipe and an inside wall of the resonator pipe in a section, where the resonator pipe surrounds the second outlet pipe, by means of which the second outlet pipe supports the resonator pipe. The annular clearance formed between the second outlet pipe and the resonator pipe is thus several times partly closed by the supports.

According to embodiments an inlet pipe is aligned with the first outlet pipe or the second outlet pipe. The alignment enables a further reduction of a flow resistance.

Embodiments further comprise at least a second partition wall defining a third volume disposed in the housing between the first and the second volumes, the third volume accommodating sound proofing. The resonator pipe and, if applicable, at least one of the at least first outlet pipe and the second outlet pipe may then optionally penetrate both the at least one first and the at least one second partition wall.

According to embodiments, a cross-section of the resonator pipe is constant along a whole length thereof.

According to embodiments, the cross-section of the resonator pipe varies along the length of the resonator pipe and increases in particular around the ports.

According to embodiments, a cross-section of the at least one first outlet pipe is constant along a whole length thereof.

According to embodiments, the cross-section of the at least one first outlet pipe varies along the length of the first outlet pipe, and increases in particular around the ports.

According to embodiments, a cross-section of the second outlet pipe is constant along a whole length of the second outlet pipe.

According to embodiments, the cross-section of the second outlet pipe varies along the length of the second outlet pipe, and increases in particular around the ports.

The variation of the cross-section may for instance be achieved by stepwise or continuous widening or tapering of the respective pipe and/or by flaring a port section of a respective pipe.

According to embodiments, the first and second outlet pipes are connected downstream of the flap by a connecting piece to form a single outlet pipe. This connecting piece may be disposed inside or outside the housing.

According to embodiments, the at least one first outlet pipe passes through the second volume and the at least one partition wall, and a wall of the at least one first outlet pipe is devoid of openings at least in the section, where the at least one first outlet pipe passes through the second volume, or a wall of the at least one first outlet pipe has openings in at least the section, where the at least one first outlet pipe passes through the second volume.

According to embodiments, a wall of the second outlet pipe is devoid of openings at least in the section where the second outlet pipe passes through the second volume, or a wall of the second outlet pipe has openings at least in the section where the second outlet pipe passes through the second volume.

According to embodiments, a wall of the resonator pipe is devoid of openings at least in a section, where the resonator pipe is located within the second volume, or a wall of the resonator pipe has openings at least in a section where the resonator pipe is located within the second volume.

According to embodiments, the inlet pipe passes through the second volume, and a wall of the inlet pipe is devoid of openings at least in the section, where the inlet pipe passes through the second volume, or a wall of the inlet pipe has openings at least in the section, where the inlet pipe passes through the second volume.

According to embodiments, the at least first one and/or second partition wall is devoid of openings, or the at least one partition wall has openings.

According to embodiments, the housing is made from stainless steel or sheet steel.

According to embodiments, the at least one partition wall is made from stainless steel or sheet steel.

According to embodiments, the at least one first inlet pipe is made from stainless steel or sheet steel, or all inlet pipes are made from stainless steel or sheet steel.

According to embodiments, the at least one first outlet pipe is made from stainless steel or sheet steel, or all first outlet pipes are made from stainless steel or sheet steel.

According to embodiments, the at least one second outlet pipe is made from stainless steel or sheet steel, or all second outlet pipes are made from stainless steel or sheet steel.

According to embodiments, the at least one resonator pipe is made from stainless steel or sheet steel, or all resonator pipes are made from stainless steel or sheet steel.

According to embodiments, the at least one inlet pipe is straight inside the housing, or all inlet pipes are straight inside the housing.

According to embodiments, the at least one first outlet pipe is straight inside the housing, or all first outlet pipes are straight inside the housing.

According to embodiments, the at least one second outlet pipe is straight inside the housing, or all second outlet pipes are straight inside the housing.

According to embodiments, the at least one resonator pipe is straight or all resonator pipes are straight.

According to embodiments, exactly one second outlet pipe is provided.

According to embodiments, exactly one resonator pipe is provided.

According to embodiments, the term that a pipe ends in a volume or a position is to be interpreted in a way that the port of the pipe is located in said volume or located at said position.

Embodiments share the concept of a switchable outlet pipe disposed in a resonator pipe that is in fluid communication with a Helmholtz volume, whereby the length of the Helmholtz pipe provided by the resonator pipe varies subject to an operating condition of the switchable outlet pipe.

According to embodiments, a standing air column and thus a resonator pipe is formed between the first volume and the second volume for each operating condition of the switchable second outlet pipe, the standing air column together with the second volume forming a Helmholtz resonator. The length and/or cross section of said standing air column are subject to the operating condition of the switchable second outlet pipe.

According to embodiments, more than one resonator pipe is provided. These further resonator pipes may be devoid of exhaust pipes. Alternatively, some or all of these further resonator pipes may each accommodate inside an exhaust pipe. Some or all of these exhaust pipes may also be switchable. These resonator pipes may hereby interact with the same or with different Helmholtz volumes. The resonator pipes may further have equal or different dimensions.

According to embodiments, a port of the at least one first outlet pipe is aligned flush with the at least one partition wall, and the partition wall is furnished with at least one corresponding opening providing a fluid communication between the at least one first outlet pipe and the first volume.

According to embodiments, a port of the second outlet pipe is aligned flush with the at least one partition wall, and the partition wall is furnished with at least one corresponding opening providing a fluid communication between the at least one second outlet pipe and the first volume.

According to embodiments, a port of the second outlet pipe is aligned flush with the at least one partition wall, and the partition wall is furnished with at least one corresponding opening providing a fluid communication between the at least one second outlet pipe and the first volume.

According to embodiments, a port of the resonator pipe is aligned flush with the at least one partition wall, and the partition wall is furnished with at least one corresponding opening providing a fluid communication between the resonator pipe and the first volume.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9K' is highly simplified schematic end view along the line of view X of FIG. 9K of a muffler according to an embodiment of the invention;

DESCRIPTION OF THE PREFERRED EMBODIMENTS

Figure 1:
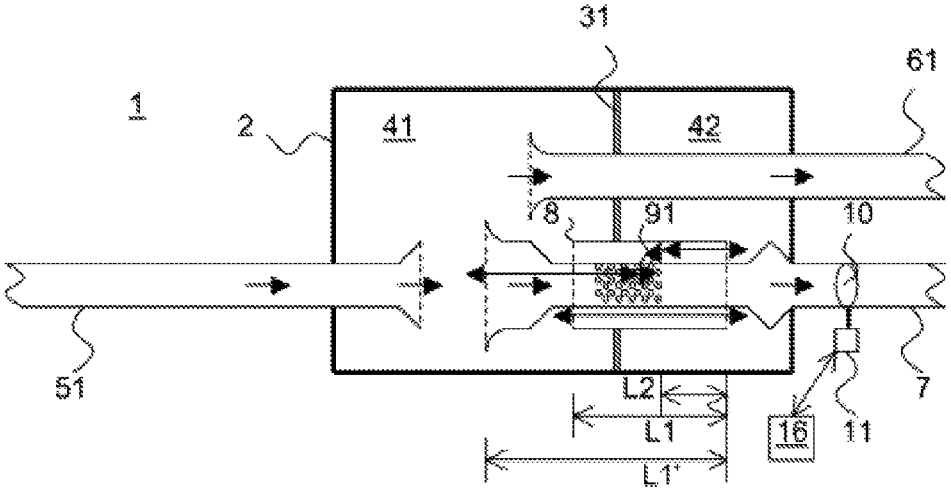
FIG. 1 is a highly simplified schematic diagram of a muffler according to a first embodiment.

Referring to the drawings, in the exemplary embodiments described below, components that are alike in function and structure are designated as far as possible by alike reference numerals. Therefore, to understand the features of the individual components of a specific embodiment, the descriptions of other embodiments and of the summary of the disclosure should be referred to.

FIG. 1 illustrates a first embodiment of a muffler according to the invention.

The muffler 1 comprises a gas-tight housing 2 made from stainless steel, whereby in its interior, a partition wall 31 made from stainless steel defines a first volume 41 and a second volume 42 separated from the first volume by the partition wall 31. A stainless steel inlet pipe 51 penetrates a wall of the housing 2 and ends in the first volume 41 having a flared port (i.e. the cross section increases towards the end). A first outlet pipe 61 and a second outlet pipe 7 penetrate a wall of the housing 2 as well as partition wall 31 and also pass through the second volume 42. Flared ports of the first outlet pipe 61 and the second outlet pipe 7 are located inside the first volume. The first outlet pipe 61 and the second outlet pipe 7 are also made from stainless steel. The first outlet pipe 61 passes through the second volume 42 and the partition wall 31 in a straight line, with its wall inside the housing 2 being devoid of openings (except for the port disposed inside the first volume). Further, the outside walls of the first outlet pipe 61 and the resonator pipe 8 are connected to the partition wall 31 by means of spot welding (and thus not in a gas-tight manner), and the inlet pipe 51 is aligned with second outlet pipe 7 and the resonator pipe 8.

Outside of the housing 2, a stainless steel flap 10 is disposed inside the second outlet pipe 7. By use of an electric motor 11, the flap may selectively be moved into a position, where the flap 10 closes the second outlet pipe 7, thus deactivating it, and into a position, where the flap 10 does not close the outlet pipe 7, thus activating it. A control line couples the electric motor 11 to an engine control unit 16 that drives the electric motor 11 subject to at least one of speed and load of an internal combustion engine (not shown). Instead of the electric motor, a hydraulic or pneumatic system may alternatively be provided for a controlled operation of flap 10.

A stainless steel resonator pipe 8 is further disposed inside the housing 2 such that the resonator pipe penetrates the partition wall 31 and surrounds the second outlet pipe 7 in the section, where the second outlet pipe 7 penetrates the at least one partition wall 31, completely in a circumferential direction with a radial spacing. The second outlet pipe 7 is thus the section, where it penetrates the partition wall 31, located inside the straight-lined resonator pipe 8. The second outlet pipe 7 hereby passes through the whole length of the resonator pipe 8 and projects beyond the resonator pipe 8 into the interior of the first volume 41.

The cross-sections of the first outlet pipe 61 and the second outlet pipe 7 vary along the pipe's longitudinal direction and are in particular increased around the ports. Also, the cross-section of the inlet pipe 51 varies along the pipe's longitudinal extension and increases in the area of the port, while the cross-section of the resonator pipe 8 remains constant along the pipe's longitudinal extension.

The resonator pipe 8 provides a fluid communication between the first volume 41 and the second volume 42 by an annular clearance formed between an outside wall of the second outlet pipe 7 and an inside wall of the resonator pipe 8.

In a section located inside of the resonator pipe 8, the second outlet pipe 7 has openings 91 in its wall that are, with regard to the partition wall 31, partly located on the side of the first volume 41 and partly on the side of the second volume 42. The resonator pipe 8, however, is devoid of any openings (except for the ports of the resonator pipe) along the whole length of a resonator pipe extension. Also, the second outlet pipe 7 provides a fluid communication between the first volume 41 and the second volume 42 by the annular clearance formed between the outside wall of the second outlet pipe 7 and the inside wall of the resonator pipe 8 and the openings 91.

Also, the partition wall 31 is, except for those openings where pipes pass through, along its entire extension devoid of openings.

The second volume 42 thus forms a Helmholtz volume, the annular clearance of the resonator pipe 8 a first Helmholtz pipe, the second outlet pipe 7 by the openings 91 and the annular clearance a second Helmholtz pipe, and the Helmholtz pipes together with the Helmholtz volume a Helmholtz resonator.

The volume of the air columns standing between the non-sealed first volume 41 and the sealed second volume 42 forms a key feature for the natural frequencies (resonance frequencies) of the Helmholtz resonator. The volumes of the standing air columns depend on length and cross-section of the respective Helmholtz pipe.

The lengths L1, L1', L2 of a respectively effective Helmholtz pipe depend on the flap 10 being open or closed, and thus on the second outlet pipe 7 being active or inactive.

For the flap 10 being opened and the second outlet pipe 7 thus being active, the effective length L2 of the first Helmholtz pipe is limited to a section of the annular clearance formed between the outside wall of the second outlet pipe 7 and the inside wall of the resonator pipe 8. This section of the annular clearance starts at the port of the resonator pipe 8 located inside the second volume 42 and extends in a longitudinal direction of the resonator pipe 8 up to the position, where the second outlet pipe 7 has the openings 91. The second Helmholtz pipe is not active when flap 10 is open, and thus features no effective length, since no standing air column is formed inside the second outlet pipe 7. Due to this, the Helmholtz resonator has only one natural frequency, when flap 10 is open.

For the flap 10 being closed and the second outlet pipe 7 thus being deactivated, the effective length L1 of the first Helmholtz pipe extends along the entire length of the annular clearance formed between the outside wall of the second outlet pipe 7 and the inside wall of the resonator pipe 8, and thus over the whole length of the resonator pipe 8. When the flap is closed, the effective length of the second Helmholtz pipe is L1', starting at the port of the resonator pipe 8 located inside the second volume 42 and extending first along the annular clearance up to the position, where the second outlet pipe 7 has the openings 91. The effective length L1' of the second Helmholtz pipe further extends through the openings 91 up to the port of the second outlet pipe 7 located inside the first volume 41. Obviously, the cross-section of the second Helmholtz pipe's standing air column varies along the length L1', since starting from the second volume 42 at first only the annular clearance formed between the outside wall of the second outlet pipe 7 and the inside wall of the resonator pipe 8 contributes to the standing air column of the second Helmholtz pipe, further on, however, the complete inner diameter of the second outlet pipe 7 contributes to the standing air column of the second Helmholtz pipe. Due to this, the Helmholtz resonator has at least two different natural frequencies, when flap 10 is closed.

The effective length L2 of the first Helmholtz pipe for flap 10 being open is further smaller than the effective lengths L1, L1' of the first and second Helmholtz pipes for flap 10 being closed, and the second outlet pipe 7 thus being deactivated. This results in the natural frequencies of the Helmholtz resonator formed by the second volume 42 and the first and second Helmholtz pipes changing subject to an operating condition of the second outlet pipe 7.

Figure 2:
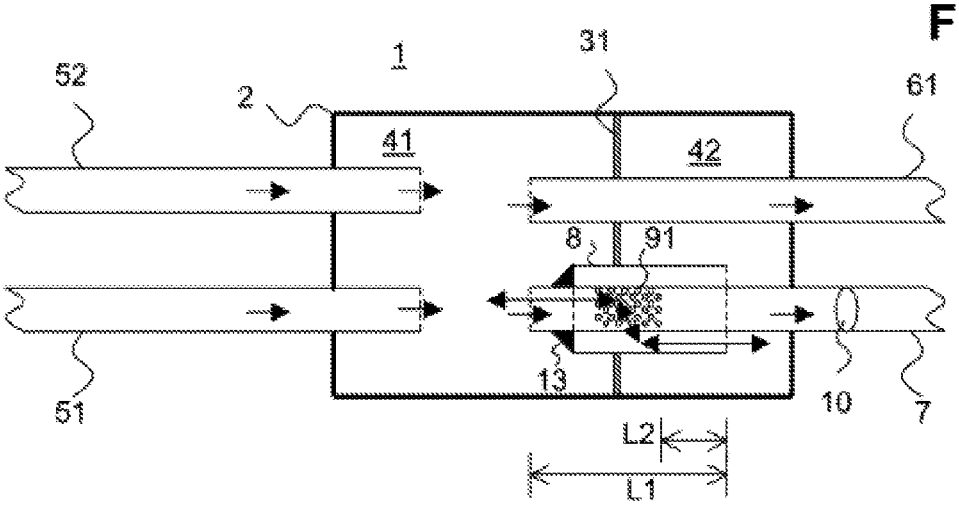
FIG. 2 is a highly simplified schematic diagram of a muffler according to a second embodiment.

Below, a second embodiment of the muffler according to the invention is described referencing FIG. 2. In order to avoid any repetitions, primarily differences to the above first embodiment will be addressed and for the balance reference will be made to the above first embodiment.

The second embodiment differs from the above first embodiment firstly, in that not only one inlet pipe 51 is provided, but also a second inlet pipe 52 that, like the first inlet pipe 51, penetrates a wall of the housing 2 and ends in the first volume 41. Different to the above first embodiment, the cross-sections of both inlet pipes 51, 52 and all outlet pipes 61, 7 are, at least inside the housing 2, constant with the pipes thus not flared in the area of their ports. In the second embodiment, a spring biases flap 10 into a closed position making it a passive component that opens automatically upon a respective application of pressure thus activating or deactivating the outlet pipe 7 automatically. In the second embodiment, the resonator pipe 8 is, at its port positioned inside the first volume 41, connected to the second outlet pipe 7 in a gas-tight manner by a welding seam 13, and the annular clearance between the second outlet pipe 7 and the resonator pipe 8 is therefore closed at this position. In this embodiment, the fluid connection between the first volume 41 and the second volume 42, and thus the Helmholtz pipe of the Helmholtz resonator, is hence provided in sections through the annular clearance between the resonator pipe 8 and the second outlet pipe 7 and in sections through the openings 91 along a section of the second outlet pipe 7.

In the second embodiment, only one air column standing between the first volume 41 and the second volume 42 is formed in each operating state of flap 10 and thus only one Helmholtz pipe is formed in each case. Consequently, the Helmholtz resonator has a different natural frequency for the flap 10 closed and for the flap 10 open.

For the flap 10 being opened and the second outlet pipe 7 thus being active, the effective length L2 of the Helmholtz pipe along the annular clearance formed between the outside wall of the second outlet pipe 7 and the inside wall of the resonator pipe 8 is limited to a section between the port of the resonator pipe 8 located inside the second volume 42 and the position where the second outlet pipe 7 has the openings 91.

For the flap 10 being closed, the Helmholtz pipe has an effective length L1, beginning at the port of the resonator pipe 8 located inside the second volume 42 and extending at first along the annular clearance up to the position where the second outlet pipe 7 has the openings 91. With flap 10 closed, the effective length L1 of the Helmholtz pipe extends further on through the openings 91 up to the second outlet pipe's 7 port located inside the first volume 41.

In the second embodiment, both inlet pipes 51, 52, the first outlet pipe 61, and the second outlet pipe 62 are straight-lined inside the housing.

Figure 3:
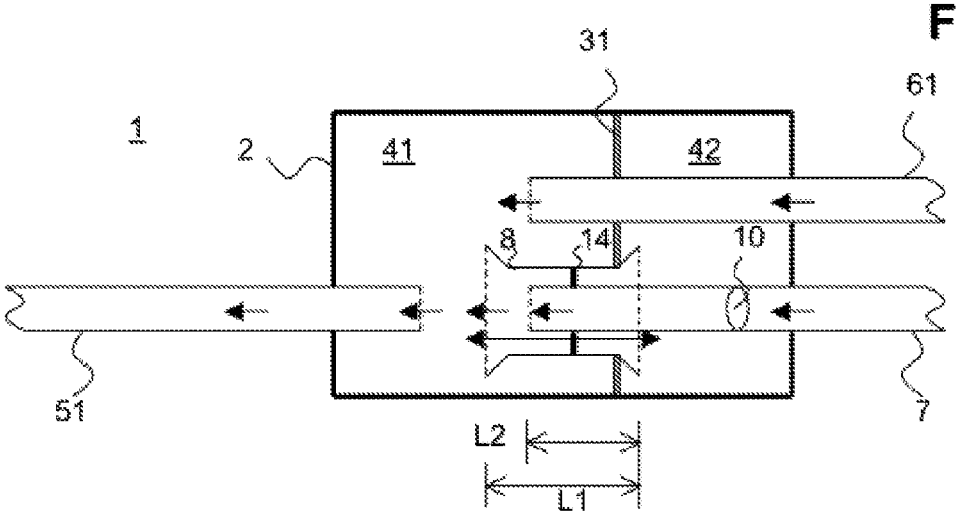
FIG. 3 is a highly simplified schematic diagram of a muffler according to a third embodiment.

Below, a third embodiment of the muffler according to the present invention will be described referencing FIG. 3. Here also primarily differences to the above first or second embodiments will be addressed to avoid any repetitions, while for the balance reference will be made to the above embodiments.

The muffler 1 according to the third embodiment differs from the muffler 1 according to the first embodiment in particular in that a passive flap 10 is used as in the second embodiment, which, different to the above first and second embodiments, is, however, not disposed outside the housing 2, but inside the housing 2 inward of the second outlet pipe 7. Furthermore, the flow direction of the exhaust gas is reversed, so that the first and second outlet pipes 7, 61 are in fluid communication with an internal combustion engine, and the inlet pipe 51 is in fluid communication with a tail pipe of an exhaust system. Further, different to the first embodiment, the cross-section of the resonator pipe 8 is not constant along its entire longitudinal extension but is flared in the area of its ports with its cross-section increased at these areas. Furthermore, the second outlet pipe 7 supports the resonator pipe 8 in this embodiment by means of a plurality of radial supports 14 spaced along a circumferential direction of the second outlet pipe 7. Different to the above first and second embodiments, the second outlet pipe 7 does not pass through the resonator pipe 8 completely, resulting in a port of the second outlet pipe 7 being located inside the resonator pipe 8 and the resonator pipe 8 projecting beyond the second outlet pipe 7 into the interior of the first volume 41. Furthermore, a wall of the second outlet pipe 7 has, like the wall of the resonator pipe, no openings.

When flap 10 is open and the second outlet pipe 7 thus active, the effective length L2 of the Helmholtz pipe is limited to the length of the annular clearance formed between the second outlet pipe 7 and the inside wall of the resonator pipe 8. The annular clearance extends between the resonator pipe's 8 port located inside the second volume 42 and the second outlet pipe's 7 port located inside the resonator pipe 8.

For the flap 10 being closed, the Helmholtz pipe has an effective length L1 that begins at the resonator pipe's 8 port located inside the second volume 42 and extends at first along the annular clearance up to the second outlet pipe's 7 port located inside the resonator pipe 8. With flap 10 closed, the effective length L1 of the Helmholtz pipe extends further on up to the resonator pipe's 8 port located inside the first volume 41. Due to the flaring of the resonator pipe 8, both the cross-section of the annular clearance and the cross-section of the resonator pipe 8 vary along the length of the resonator pipe 8.

Depending on an operational state of the second outlet pipe 7, the Helmholtz pipe of the Helmholtz resonator thus formed has two different lengths L1 and L2 as well as two different cross-sections, and the thus formed Helmholtz resonator can hence be tuned between (at least) two different natural frequencies.

A fourth embodiment of the muffler according to the present invention will be described below referencing FIG. 4. In order to avoid repetitions, primarily differences to the above first to third embodiments will be addressed, and for the balance reference will be made to the above explanations.

Figure 4:
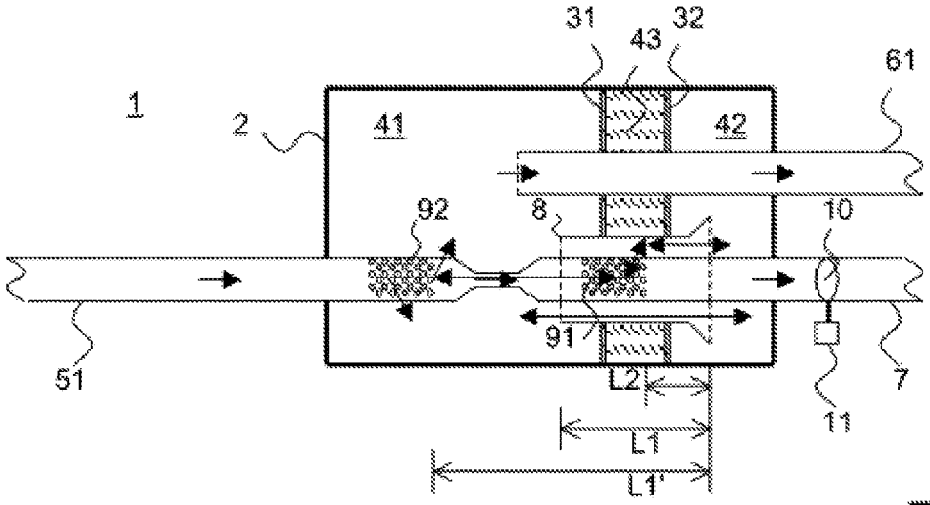
FIG. 4 is a highly simplified schematic diagram of a muffler according to a fourth embodiment.

The fourth embodiment shown in FIG. 4 differs from the above embodiments basically by a provision of a further stainless steel partition wall 32 defining a third volume 43 filled with sound proofing and located between the first volume 41 and the second volume 42. The first outlet pipe 61 and the second outlet pipe 7 in this case not only penetrate the wall of the housing 2 in a gas-tight manner but also penetrate the first partition wall 31 and the second partition wall 32 in a sliding fit. Also, the resonator pipe 8 has a port which is flared in the embodiment shown to result in an enlarged cross-section and which is located inside the housing 42. The resonator pipe 8 penetrates both the first partition wall 31 and the second partition wall 32 in a sliding fit. In the embodiment shown, the inlet pipe 51 and the outlet pipe 7 are formed integrally. A wall of the single-piece pipe thus formed has openings 92 inside the first volume 41, in a section where the pipe is not surrounded by the resonator pipe 8, which enable fluid traveling inside the inlet pipe 51 to pass over into the first volume 41. The pipe integrally formed by the inlet pipe 51 and the second outlet pipe 7 further also has openings 91 in a section where it is located inside the resonator pipe 8. Between the openings 91 and 92, the pipe integrally formed by the inlet pipe 51 and the second outlet pipe 7 comprises a section having a modified and in the present case reduced diameter acting as a throttle. In FIG. 4 as in following FIGS. 5 and 6, no controller for the electric motor 11 is shown for reasons of simplification. It is obvious that the sliding fit between the pipe integrally formed by the inlet pipe 51 and the second outlet pipe 7 and the first partition wall 31 and the second partition wall 32 is achieved via the resonator pipe 8. Thus, no direct contact between the pipe integrally formed by the inlet pipe 51 and the second outlet pipe 7 and the first partition wall 31 and the second partition wall 32 is required.

As in the first and second embodiment, the effective length L2 of the Helmholtz pipe for the flap 10 being open and the second outlet pipe 7 thus active is limited to a section along the annular clearance formed between the outside wall of the second outlet pipe 7 and the inside wall of the resonator pipe 8, the section being located between the resonator pipe's 8 port disposed inside the second volume 42 and the position where the pipe integrally formed by the inlet pipe 51 and the second outlet pipe 7 has openings 91.

When flap 10 is closed, the effective length L1 of a first Helmholtz pipe extends along the entire length of the annular clearance formed between the outside wall of the pipe integrally formed by the inlet pipe 51 and the second outlet pipe 7 and the inside wall of the resonator pipe 8, and thus along the entire length of resonator pipe 8. Furthermore, with flap 10 closed, a second Helmholtz pipe has an effective length L1' starting at the resonator pipe's 8 port located inside the second volume 42 and extending at first along the annular clearance up to the position where the pipe integrally formed by the inlet pipe 51 and the second outlet pipe 7 has the openings 91. With flap 10 closed, the effective length L1 of the Helmholtz pipe extends further on through the openings 91 inside the pipe integrally formed by the inlet pipe 51 and the second outlet pipe 7 up to the position where the pipe integrally formed by the inlet pipe 51 and the second outlet pipe 7 has the openings 92.

Like in the first embodiment, the volumes of the standing air columns of the Helmholtz resonator thus formed vary, subject to the flap 10 located inside the second outlet pipe 7 being open or closed, resulting in the natural frequencies of the Helmholtz resonator being switchable.

Figure 5:
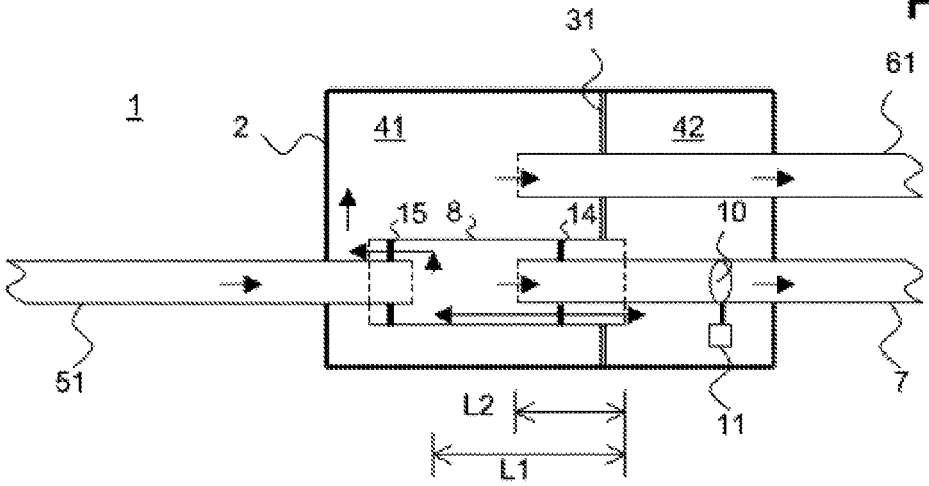
FIG. 5 is a highly simplified schematic diagram of a muffler according to a fifth embodiment.

Referencing FIG. 5, a fifth embodiment of a muffler according to the invention will be described below, whereby, for avoiding repetitions, it will be referred to the explanations for the above first to fourth embodiments and primarily differences will be addressed.

The fifth embodiment differs from the above third embodiment particularly in that a port of the inlet pipe 51 is disposed inside the resonator pipe 8, and in that the resonator pipe 8 is also supported by the inlet pipe 51 by means of radial supports 15 spaced in a circumferential direction of the inlet pipe 51. Different to the third embodiment, the ports of the resonator pipe 8 are not flared and the cross-section of the resonator pipe 8 is thus constant along its entire longitudinal extension. Accordingly, the first volume 41 receives in this embodiment fluid, and in particular exhaust gas, traveling through inlet pipe 51 from an annular clearance between the resonator pipe 8 and the inlet pipe 51.

With flap 10 open and the second outlet pipe 7 thus being active, the effective length L2 of the Helmholtz pipe is limited to the length of the annular clearance formed between the outside wall of the second outlet pipe 7 and the inside wall of the resonator pipe 8. This annular clearance extends from the resonator pipe's 8 port located in the second volume 42 up to the second outlet pipe's 7 port located inside the resonator pipe 8.

When flap 10 is closed, the effective length L1 of the Helmholtz pipe begins at the resonator pipe's 8 port located inside the second volume 42 and extends at first along the annular clearance up to the second outlet pipe's 7 port located inside the resonator pipe 8. With flap 10 closed, the effective length L1 of the Helmholtz pipe extends further on up to a position in front of the port of the inlet pipe 51 located inside the resonator pipe 8. Accordingly, at first, only the cross-section of the annular clearance and later the cross-section of the resonator pipe 8 contribute to the air column standing in the Helmholtz pipe between the first and second volumes 41, 42.

The volume of the standing air column of the Helmholtz resonator formed by the Helmholtz pipe and the second volume 42 can be adjusted with a flap 10 operated by an electric motor 11 and located inside the housing 2 inward the second outlet pipe 7, resulting in the Helmholtz resonator having (at least) two switchable natural frequencies.

Figure 6:
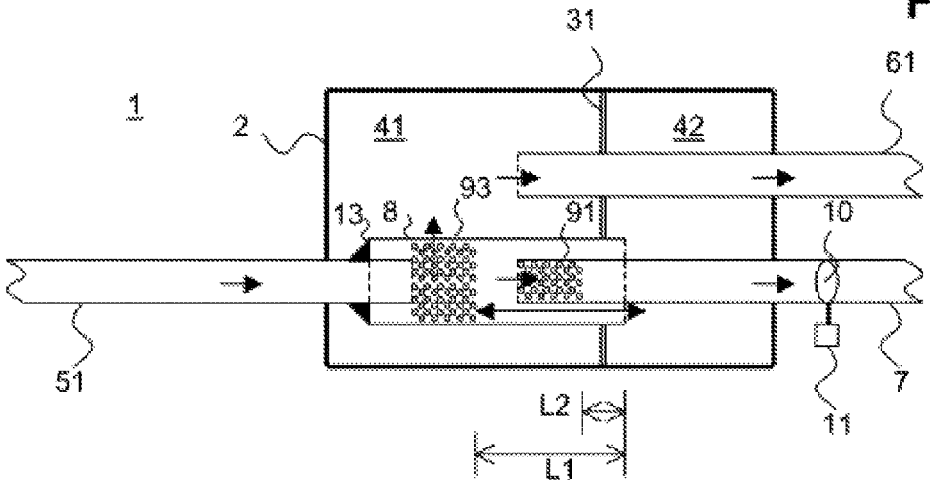
FIG. 6 is a highly simplified schematic diagram of a muffler according to a sixth embodiment.

Below, a sixth embodiment of a muffler according to the invention is described referencing FIG. 6. In order to avoid any repetitions, differences to the above fifth embodiment will be addressed primarily, and for the balance reference will be made to the above embodiments.

The muffler 1 according to the sixth embodiment differs from the above fifth embodiment particularly in that the annular clearance between the resonator pipe 8 and the inlet pipe 51 is sealed by means of a welding seam 13. An annular cover may be used as an alternative to the welding seam 13. In exchange, the resonator pipe 8 is provided with openings 93 in a section not penetrated by the second outlet pipe 7, the openings 93 enabling fluid passing through the inlet pipe 51 to be introduced into the volume 41. In the embodiment shown in FIG. 6, also the second outlet pipe 7 has openings 91 formed in its wall.

With flap 10 open and the second outlet pipe 7 thus being active, the effective length L2 of the Helmholtz pipe is limited to a section along the annular clearance formed between the outside wall of the second outlet pipe 7 and the inside wall of the resonator pipe 8 located between the resonator pipe's 8 port disposed inside the second volume 42 and the position where the second outlet pipe 7 has its openings 91.

When flap 10 is closed, the effective length L1 of the Helmholtz pipe begins at the resonator pipe's 8 port located inside the second volume 42 and extends at first along the annular clearance up to the second outlet pipe's 7 port located inside the resonator pipe 8. In the area around the openings 91, not only the annular clearance but also the cross-section of the second outlet pipe contribute to the air column standing in the Helmholtz pipe. With flap 10 closed, the effective length L1 of the Helmholtz pipe further extends inside the resonator pipe 8 up to the openings 93 of the resonator pipe 8.

The effective length L1, L2 and the effective cross-section of the Helmholtz pipe 8 of the Helmholtz resonator thus formed depends on the flap 10 arranged inside the second outlet pipe 7 being open or closed, resulting in the Helmholtz resonator being switchable between (at least) two natural frequencies.

Figure 7:
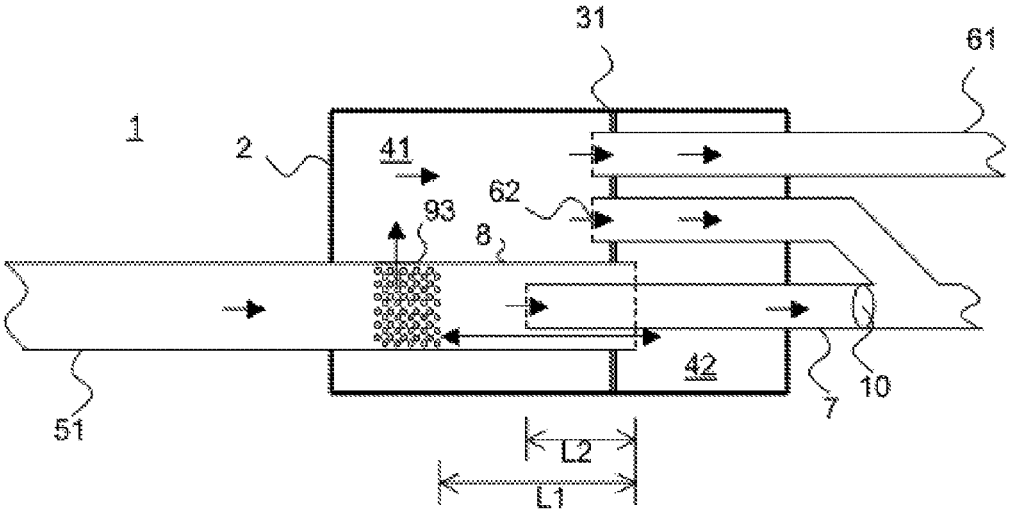
FIG. 7 is a highly simplified schematic diagram of a muffler according to a seventh embodiment.

Below, a seventh embodiment of a muffler according to the invention is described referencing FIG. 7. In order to avoid any repetitions, primarily differences to the above sixth embodiment will be addressed, and for the balance reference will be made to the above explanations.

The muffler 1 according to the seventh embodiment comprises a resonator pipe 8 formed integrally with the inlet pipe 51 that passes through the wall of housing 2 and the partition wall 31 and ends within the second volume 42. In a section inside the first volume 41 where the second outlet pipe 7 is not present, the resonator pipe 8 formed integrally with the inlet pipe 51 comprises openings 93 allowing fluid, and in particular exhaust gas, traveling through the inlet pipe 51 to pass over into the first volume 41. A wall of the resonator pipe 8 formed integrally with the inlet pipe 51 is devoid of outlet openings in a section where the second outlet pipe 7 is located inside the resonator pipe 8 formed integrally with the inlet pipe 51. In the embodiment shown, two first outlet pipes 61 and 62 are provided, of which one first outlet pipe is, by means of a connecting piece, connected to the second outlet pipe 7 at a position downstream of flap 10 disposed inside the second outlet pipe 7 to form a single common outlet pipe. Alternatively, also all outlet pipes may be interconnected downstream of flap 10 disposed inside the second outlet pipe 7.

With flap 10 open, the effective length L2 of the Helmholtz pipe begins at the resonator pipe's 8 port located inside the second volume 42 and extends via the annular clearance (between the resonator pipe 8 formed integrally with the inlet pipe 51 and the second outlet pipe 7) up to the second outlet pipe's 7 port located inside the resonator pipe 8. Hence, with flap 10 open, only the annular clearance contributes to the standing air column.

The effective length L1 of the Helmholtz pipe with flap 10 closed starts at the resonator pipe's 8 port located inside the second volume 42 and extends at first along the annular clearance (between the resonator pipe 8 formed integrally with the inlet pipe 51 and the second outlet pipe 7) up to the port of the second outlet pipe 7 located inside the resonator pipe 8. With flap 10 closed, the effective length L1 of the Helmholtz pipe extends further on inside the resonator pipe 8 up to the openings 93 of the resonator pipe 8.

Depending on flap 10, configured as a passive flap in this embodiment, being open or closed, an effective length and an effective cross-section, and thus a volume of the thus formed Helmholtz resonator's standing air column between the open first volume 41 and the sealed second volume 42, is switchable so that also the respective natural frequency of the Helmholtz resonator changes. It is noted that even though in this embodiment the connecting piece between the outlet pipes is located outside of housing 2, it may as well also be located inside the housing 2.

Figure 8:
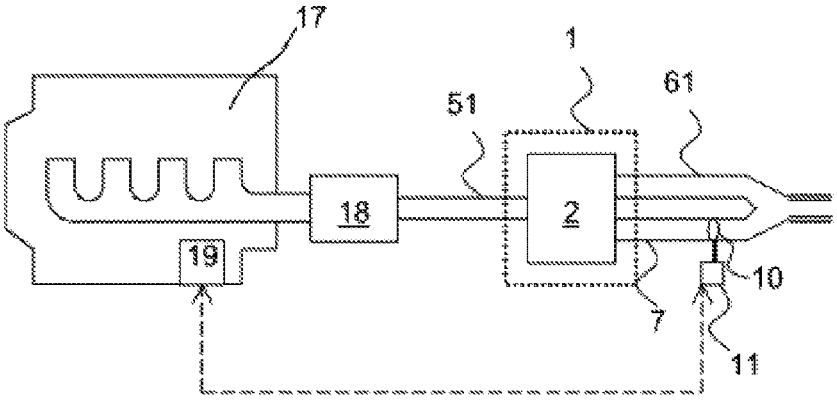
FIG. 8 is a highly simplified schematic diagram of an exhaust system using a muffler according to an embodiment of the invention.

Referencing FIG. 8, an embodiment of an exhaust system will be described below that uses a muffler according to one of the above embodiments.

Exhaust gas from an internal combustion engine 17 passes through a catalytic converter 18 and an inlet pipe 51 into a housing 2 of one of the above mufflers 1. Downstream of flap 10 disposed inside the second outlet pipe 7, the flap forming in the embodiment shown part of the general exhaust system rather than part of the muffler 1, the first outlet pipe 61 and the second outlet pipe 7 are joined by means of a Y-pipe prior to the exhaust gas being discharged through a tail pipe. In the illustrated embodiment, an engine control unit 19 controls the electric motor 11 operating flap 10 subject to a respective speed of the internal combustion engine 17.

Figure 9J:
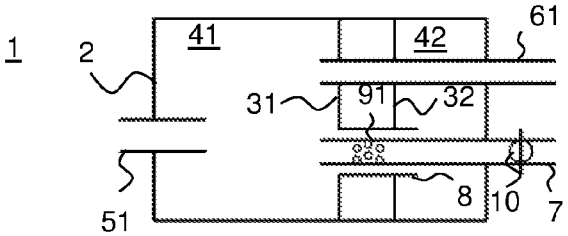
FIG. 9J is a highly simplified schematic diagram of a muffler according to an embodiment of the invention.
Figure 9A:
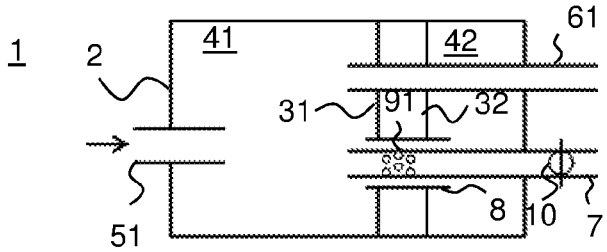
FIG. 9A is a highly simplified schematic diagram of a muffler according to an embodiment of the invention.

Referencing FIG. 9A, a muffler 1 according to an eighth embodiment will be described below. The muffler 1 corresponds mostly to the muffler 1 of the embodiment shown in FIG. 1. In order to avoid any repetitions, primarily differences to the above first embodiment will be addressed, and for the balance reference will be made to the above explanations provided for the first embodiment.

The muffler 1 according to the eighth embodiment differs from the muffler according to the first embodiment in that the cross section of the inlet pipe 5, the first outlet pipe 61, and the second outlet pipe 7 is continuously constant. Accordingly, the flaring in the area near the ports has been omitted. Further, a second partition wall 32 parallel to the partition wall 31 is provided inside the housing 2. The resonator pipe 8 penetrates both partition walls 31 and 32. Using two spaced apart partition walls 31, 32 eases stabilization and thus guarantees support of the resonator pipe 8 inside of the housing 2.

Figure 9B:
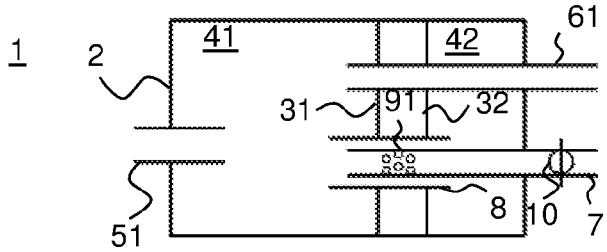
FIG. 9B is a highly simplified schematic diagram of a muffler according to an embodiment of the invention.

Referencing FIG. 9B, a muffler 1 according to a ninth embodiment will be described below. The muffler corresponds mostly to the muffler of the third embodiment shown in FIG. 3. In order to avoid any repetitions, primarily differences to the above third embodiment will be addressed, and for the balance reference will be made to the above explanations provided for the third embodiment.

The muffler 1 according to the ninth embodiment differs from the muffler according to the third embodiment in that the cross section of the resonator pipe 8 is continuously constant. Accordingly, the flaring of the resonator pipe 8 in the area near the ports shown in FIG. 3 has been omitted. According to the ninth embodiment, the second outlet pipe 7 further does not support the resonator pipe 8 by means of a plurality of radial supports 14 spaced along a circumferential direction of the second outlet pipe 7. The annular clearance formed between the resonator pipe 8 and the second outlet pipe 7 is, however, devoid of any support. The second outlet pipe 7 is finally furnished with openings 91 in a section where it is disposed inside the resonator pipe 8. Like in the above eighth embodiment, a further partition wall 32 parallel to the partition wall 31 is provided inside the housing 2 with the resonator pipe 8 penetrating both partition walls 31 and 32.

Figure 9C:
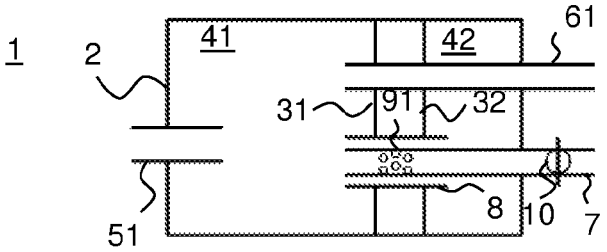
FIG. 9C is a highly simplified schematic diagram of a muffler according to an embodiment of the invention.

Referencing FIG. 9C, a muffler 1 according to a tenth embodiment will be described below. The muffler corresponds to a crossover between the above eighth embodiment and the above ninth embodiment. In order to avoid any repetitions, primarily differences to the above eighth and ninth embodiments will be addressed, and for the balance reference will be made to the above explanations provided for the eighth and ninth embodiment.

The muffler 1 according to the tenth embodiment differs from the muffler according to the eighth embodiment by the second outlet pipe 7 not projecting beyond the resonator pipe 8 into the first volume 41. The ports of the second outlet pipe 7 and the resonator pipe 8 are instead flush with each other. Different to the ninth embodiment, the port of the second outlet pipe 7 is therefore disposed inside the resonator pipe 8 in a radial direction of the resonator pipe 8 only but not also in an axial direction of the resonator pipe 8.

Referencing FIG. 9D, a muffler 1 according to an eleventh embodiment will be described below. The muffler 1 corresponds mostly to the muffler of the second embodiment shown in FIG. 2. In order to avoid any repetitions, primarily differences to the above second embodiment will be addressed, and for the balance reference will be made to the above explanations provided for the second embodiment.

The muffler 1 according to the eleventh embodiment differs from the muffler according to the second embodiment in that an annular cover 13 instead of a welding seam seals the annular clearance between the second outlet pipe 7 and the resonator pipe 8 in a gas tight manner. Further, only one inlet pipe 51 is provided, with the second inlet pipe 52 being omitted. Like in the above eighth to tenth embodiments, a second partition wall 32 parallel to the first partition wall 31 is provided inside the housing 2, and the resonator pipe 8 (and thus also the second outlet pipe 7 disposed inside the resonator pipe 8) penetrates both partition walls 31 and 32. The use of an annular cover 13 enables a mutual support of the resonator pipe 8 and the second outlet pipe 7.

Referencing FIGS. 9E and 9F, a muffler 1 according to a twelfth and according to a thirteenth embodiment will be described below. The muffler is based on the above eleventh embodiment. In order to avoid any repetitions, primarily differences to the above eleventh embodiment will be addressed, and for the balance reference will be made to the above explanations provided for the eleventh embodiment.

Figure 9D:
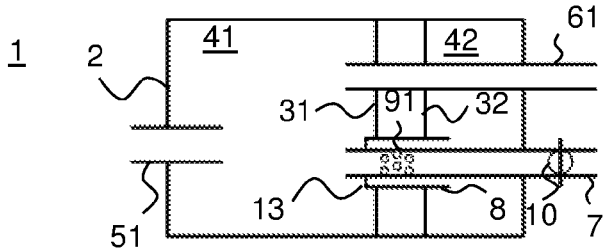
FIG. 9D is a highly simplified schematic diagram of a muffler according to an embodiment of the invention.
Figure 9E:
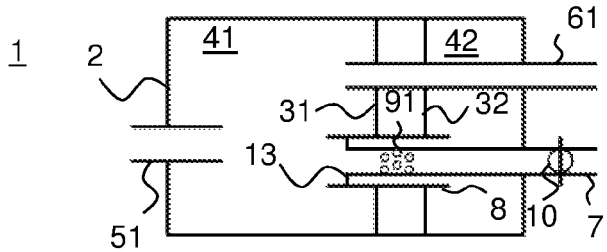
FIG. 9E is a highly simplified schematic diagram of a muffler according to an embodiment of the invention.

The muffler 1 according to the twelfth embodiment shown in FIG. 9E differs from the muffler according to the eleventh embodiment by the second outlet pipe 7 not projecting beyond the resonator pipe 8 into the first volume 41. The resonator pipe 8 instead projects beyond a port of the second outlet pipe 7 into the first volume 41. Accordingly, a port of the second outlet pipe is in a radial direction as well as in an axial direction of the resonator pipe 8 disposed inside the resonator pipe 8 and spaced apart from a port of the resonator pipe 8.

Figure 9F:
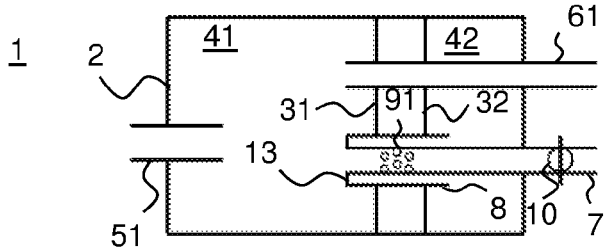
FIG. 9F is a highly simplified schematic diagram of a muffler according to an embodiment of the invention.

The muffler 1 according to the thirteenth embodiment shown in FIG. 9F differs from the muffler according to the eleventh embodiment shown in FIG. 9D by the second outlet pipe 7 not projecting beyond the resonator pipe 8 into the first volume 41. The ports of the second outlet pipe 7 and the resonator pipe 8 are instead flush with each other.

Figure 9G:
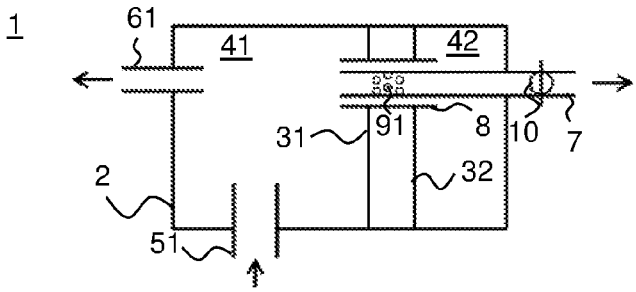
FIG. 9G is a highly simplified schematic diagram of a muffler according to an embodiment of the invention.

Referencing FIG. 9G, a muffler 1 according to a fourteenth embodiment will be described below. The muffler corresponds mostly to the muffler of the tenth embodiment shown in FIG. 9C. In order to avoid any repetitions, primarily differences to the above tenth embodiment will be addressed, and for the balance reference will be made to the above explanations provided for the tenth embodiment.

The muffler 1 according to the fourteenth embodiment differs from the muffler of the tenth embodiment in particular by the arrangement of the inlet pipe 51 and the first outlet pipe 61. Different to the tenth embodiment, the first outlet pipe 61 does not penetrate the partition walls 31 and 32. Instead, the first outlet pipe 61 and the second outlet pipe 7 exit the housing 2 on opposite sides of the housing 2. The inlet pipe 51 is arranged such that it is not aligned with one of the outlet pipes 61, 7. Instead it is arranged at an angle of 90° with respect to the outlet pipes 61, 7.

The arrangement of the pipes in the fourteenth embodiment represents only an example for illustrating that the at least one inlet pipe and the outlet pipes may be arranged in any configuration with respect to each other, provided that all pipes end in the first volume 41 and that the second outlet pipe 7 is at least in part surrounded by the resonator pipe 8 disposed between the first volume 41 and the second volume 42. It is further appreciated that the use of a plurality of partition walls is only optional. More than two or only one partition wall may be used alternatively. The cross section of the at least one inlet pipe and the outlet pipes as well as of the at least one resonator pipe may constant along their longitudinal extension, or they may have an enlarged cross section in the area around their ports and thus be flared.

Figure 9H:
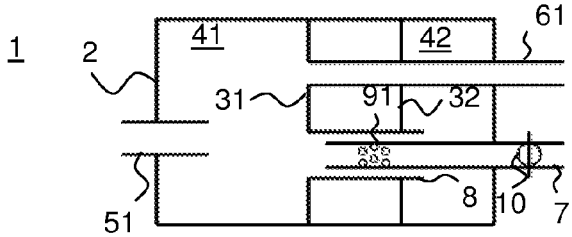
FIG. 9H is a highly simplified schematic diagram of a muffler according to an embodiment of the invention.

Referencing FIG. 9H, a muffler 1 according to a fifteenth embodiment will be described below. The muffler corresponds mostly to the muffler of the ninth embodiment shown in FIG. 9B. In order to avoid any repetitions, primarily differences to the above ninth embodiment will be addressed, and for the balance reference will be made to the above explanations provided for the ninth embodiment.

The muffler 1 according to the fifteenth embodiment differs from the muffler of the ninth embodiment by the ports of the first outlet pipe 61 and the resonator pipe 8 being flush with the partition wall 31. Accordingly, none of the first outlet pipe 61 and the resonator pipe 8 projects beyond the partition wall 31 into the first volume 41. The port of the second outlet pipe 7 is set back with respect to the port of the resonator pipe 8 such that the second outlet pipe 7 does not penetrate the partition wall 31.

Figure 9I:
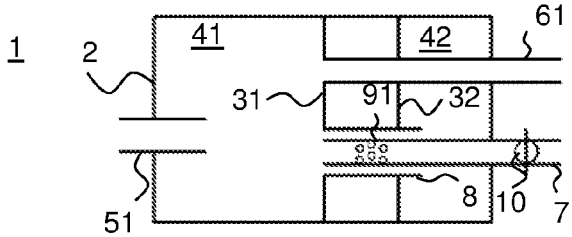
FIG. 9I is a highly simplified schematic diagram of a muffler according to an embodiment of the invention.

Referencing FIG. 9I, a muffler 1 according to a sixteenth embodiment will be described below. This muffler corresponds mostly to the muffler of the tenth embodiment shown in FIG. 9C. In order to avoid any repetitions, primarily differences to the above tenth embodiment will be addressed, and for the balance reference will be made to the above explanations provided for the tenth embodiment.

The muffler 1 according to the sixteenth embodiment differs from the muffler of the tenth embodiment by the ports of the first outlet pipe 61, the second outlet pipe 7, and the resonator pipe 8 being flush with the partition wall 31. Accordingly, neither the first outlet pipe 61, the second outlet pipe 7, nor the resonator pipe 8 project beyond the partition wall 31 into the first volume 41.

Referencing FIG. 9J, a muffler 1 according to a seventeenth embodiment will be described below. This muffler corresponds mostly to the muffler of the eighth embodiment shown in FIG. 9A. In order to avoid any repetitions, primarily differences to the above eighth embodiment will be addressed, and for the balance reference will be made to the above explanations provided for the eighth embodiment.

The muffler 1 according to the seventeenth embodiment differs from the muffler of the eighth embodiment by the port of the resonator pipe 8 being flush with the partition wall 31. Accordingly, only the first outlet pipe 61 and the second outlet pipe 7 project beyond the partition wall 31 into the first volume 41.

Referencing FIGS. 9K and 9K', a muffler 1 according to an eighteenth embodiment will be described below. This muffler corresponds mostly to the muffler of the sixteenth embodiment shown in FIG. 9I. In order to avoid any repetitions, primarily differences to the above sixteenth embodiment will be addressed, and for the balance reference will be made to the above explanations provided for the sixteenth embodiment.

Figure 9K:
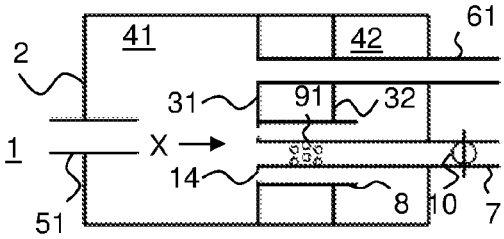
FIG. 9K is a highly simplified schematic diagram of a muffler according to an embodiment of the invention.
Figure 9K:
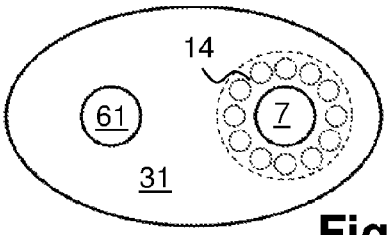

FIG. 9K shows a highly simplified schematic diagram of the muffler 1 according to the eighteenth embodiment, while FIG. 9K' shows a top view onto the partition wall 31 along the line of view X, with the partition wall 31 being rotated by 90° counterclockwise with respect to the drawing on the left side.

The muffler 1 according to the eighteenth embodiment differs from the muffler of the sixteenth embodiment by supports 14 being disposed inside the annular clearance between the resonator pipe 8 and the second outlet pipe 7. The supports are formed by the partition wall 31 by providing a plurality of circularly arranged openings in the area of the partition wall 31 where the partition wall seals the annular clearance formed between the resonator pipe 8 and the second outlet pipe 7. The supports 14 remain between these openings. This way, a mostly open annular clearance is obtained, while a support of the second outlet pipe 7 by the partition wall 31 is ensured.

It is noted that the form of supporting the second outlet pipe shown in the eighteenth embodiment represents an example only. The supporting may alternatively be achieved by for instance pins disposed between the resonator pipe and the second outlet pipe or between the partition wall and the second outlet pipe, or by tabs formed at one of the partition walls or the bypass pipe, or by indentations or protrusions formed on the resonator pipe or the second outlet pipe.

Figure 9L:
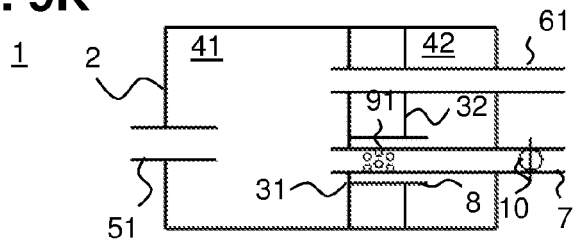
FIG. 9L is a highly simplified schematic diagram of a muffler according to an embodiment of the invention.

Referencing FIG. 9L, a muffler according to a nineteenth embodiment will be described below. This muffler corresponds mostly to the muffler of the eleventh embodiment shown in FIG. 9D. In order to avoid any repetitions, primarily differences to the above eleventh embodiment will be addressed, and for the balance reference will be made to the above explanations provided for the eleventh embodiment.

The muffler according to the nineteenth embodiment differs from the muffler of the eleventh embodiment in particular by the port of the resonator pipe 8 being flush with the partition wall 31. Accordingly, only the first outlet pipe 61 and the second outlet pipe 7 project beyond the partition wall 31 into the first volume 41. Furthermore, the annular clearance formed between the resonator pipe 8 and the second outlet pipe 7 is not sealed by the separate annular clearance but by the partition wall 31 itself. This also enables the partition wall 31 to directly support both the first and second outlet pipes 61, 7 and the resonator pipe 8.

Figure 9M:
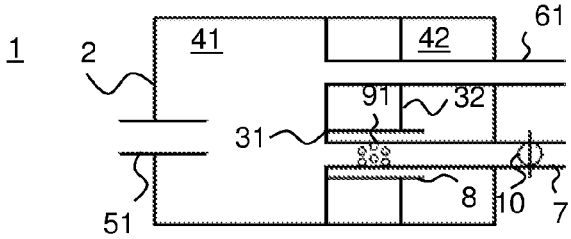
FIG. 9M is a highly simplified schematic diagram of a muffler according to an embodiment of the invention.

Referencing FIG. 9M, a muffler according to a twentieth embodiment will be described below. This muffler corresponds mostly to the muffler of the thirteenth embodiment shown in FIG. 9F. In order to avoid any repetitions, primarily differences to the above thirteenth embodiment will be addressed, and for the balance reference will be made to the above explanations provided for the thirteenth embodiment.

The muffler according to the twentieth embodiment differs from the muffler of the thirteenth embodiment particularly in that the ports of the first outlet pipe 61, the second outlet pipe 7, and the resonator pipe 8 are flush with the partition wall 31. Accordingly, neither the first outlet pipe 61, nor the second outlet pipe 7, nor the resonator pipe 8 project beyond the partition wall 31 into the first volume 41. Furthermore, the annular clearance formed between the resonator pipe 8 and the second outlet pipe 7 is not sealed by a separate annular cover, but instead by the partition wall 31 itself.

Although the term "Helmholtz pipe" has been used above for indicating the area where a standing air column is formed between the open first volume and the sealed second volume, said term is to be understood in its functional meaning and not in a limiting way (e.g. limited to a physical pipe). Accordingly, the Helmholtz pipe may have any cross-section, and in particular also a cross-section that varies along the Helmholtz pipe.

Further it is appreciated that the term "annular clearance" used above is not limited to clearances of circular cross-sections, but is also intended to cover clearances of oval or rectangular cross-sections. Furthermore, the clearances may be continuous in a circumferential direction, but may alternatively also be discontinuous in a circumferential direction.

While the disclosure has been described with respect to certain exemplary embodiments thereof, it is evident that many alternatives, modifications and variations will be apparent to those skilled in the art. Accordingly, the exemplary embodiments of the disclosure set forth herein are intended to be illustrative and not limiting in any way. Various changes may be made without departing from the spirit and scope of the present disclosure as defined in the following claims.

What is claimed is:

1. A muffler for an exhaust system of a vehicle driven by an internal combustion engine, the muffler comprising:

a gas-tight housing;

a partition wall disposed inside said housing, the partition wall dividing the interior of the housing into a first volume and a second volume separate from the first volume;

an inlet pipe in fluid communication with the first volume;

a first outlet pipe in fluid communication with the first volume;

a switchable second outlet pipe in fluid communication with the first volume, the switchable second outlet pipe passing through the second volume, and the switchable second outlet pipe penetrating the partition wall; and a resonator pipe providing fluid communication between the first volume and the second volume, wherein:

the switchable second outlet pipe is disposed inside the resonator pipe in a section where the switchable second outlet pipe penetrates the partition wall;

the resonator pipe has a first section at which the resonator pipe is located inside the first volume and at which the second outlet pipe is not present; and the resonator pipe has a second section at which the resonator pipe accommodates the second outlet pipe.

2. A muffler according to claim 1, wherein a port of the inlet pipe is disposed inside the resonator pipe.

3. A muffler according to claim 2, wherein at least one of:

a wall of the resonator pipe is devoid of openings in a section at which the second outlet pipe is not present; and a wall of the resonator pipe has openings in a section in a section at which the second outlet pipe is not present.

4. A muffler according to claim 1, wherein a wall of the switchable second outlet pipe has openings in a section of the switchable second outlet pipe at which the resonator pipe surrounds the switchable second outlet pipe.

5. A muffler according to claim 1, wherein an end of the resonator pipe is located inside the first volume and is connected to the switchable second outlet pipe in a gas-tight manner.

6. A muffler according to claim 1, further comprising a flap disposed in the switchable second outlet pipe, inside or outside the housing, the flap being configured to selectively close the second outlet pipe.

7. A muffler according to claim 6, further comprising an electric motor configured for selectively opening and closing the flap and configured for being coupled to a controller.

8. A muffler according to claim 6, wherein the flap is biased, with a bias force, into a position for closing the switchable second outlet pipe, the bias force being such that the flap is opened against the bias force upon the pressure of the exhaust gas applied to the flap equaling a predetermined value.

9. A muffler according to claim 1, wherein at least one of:

an outside wall of the first outlet pipe is connected to the partition wall in a gas-tight manner; and an outside wall of the resonator pipe is connected to the partition wall in a gas tight manner.

10. A muffler according to claim 1, further comprising radially extending supports disposed between an outside wall of the second outlet pipe and an inlet wall of the resonator pipe in a section at which the resonator pipe surrounds the second outlet pipe.

11. A muffler according to claim 1, wherein an inlet pipe is aligned with the first outlet pipe or with the switchable second outlet pipe.

12. A muffler according to claim 1, further comprising a second partition wall defining a third volume located inside the housing between the first volume and the second volume, the third volume accommodating sound proofing.

13. A muffler for an exhaust system of a vehicle driven by an internal combustion engine, the muffler comprising:

a gas-tight housing comprising a first volume and a second volume;

a partition wall disposed inside said housing, said first volume being separated from said second volume via said partition wall, said partition wall comprising a partition wall opening;

an inlet pipe in fluid communication with said first volume;

a first outlet pipe in fluid communication with said first volume;

a switchable second outlet pipe in fluid communication with said first volume, said switchable second outlet pipe extending through said second volume, and the switchable second outlet pipe extending through said partition wall opening; and a resonator pipe providing fluid communication between said first volume and said second volume, wherein:

said switchable second outlet pipe is disposed inside said resonator pipe in a section where said switchable second outlet pipe extends through said partition wall opening;

said resonator pipe has a first section at which said resonator pipe is located inside said first volume, said first section being free of said second outlet pipe; and said resonator pipe comprises a second section, at least a portion of second outlet pipe being arranged in said second section of said resonator pipe.

14. A muffler according to claim 13, wherein a port of the inlet pipe is disposed inside the resonator pipe.

15. A muffler according to claim 14, wherein at least one of:

a wall of the resonator pipe is devoid of openings in a section at which the second outlet pipe is not present; and a wall of the resonator pipe has openings in a section in a section at which the second outlet pipe is not present.

16. A muffler according to claim 13, wherein a wall of the switchable second outlet pipe has openings in a section of the switchable second outlet pipe at which the resonator pipe surrounds the switchable second outlet pipe.

17. A muffler for an exhaust system of a vehicle driven by an internal combustion engine, the muffler comprising:

a gas-tight housing comprising a first volume and a second volume;

a partition wall disposed inside said housing, said first volume being separated from said second volume via said partition wall, said partition wall comprising a partition wall opening;

an inlet pipe in fluid communication with said first volume;

a first outlet pipe in fluid communication with said first volume;

a switchable second outlet pipe in fluid communication with said first volume, said switchable second outlet pipe extending through said second volume, and the switchable second outlet pipe extending through said partition wall opening; and a resonator pipe providing fluid communication between said first volume and said second volume, wherein:

said switchable second outlet pipe comprises a first switchable second outlet pipe end portion and a second switchable second outlet pipe end portion;

said resonator pipe has a first section and a second section, said first section being located inside said first volume;

said first switchable second outlet pipe end portion is located at a spaced location from said first section;

said second switchable second outlet pipe end portion is located a position outside of said housing; and at least a portion of second switchable outlet pipe is arranged in said second section of said resonator pipe.

18. A muffler according to claim 17, wherein a port of the inlet pipe is disposed inside the resonator pipe.

19. A muffler according to claim 18, wherein at least one of:

a wall of the resonator pipe is devoid of openings in a section at which the second outlet pipe is not present; and a wall of the resonator pipe has openings in a section in a section at which the second outlet pipe is not present.

20. A muffler according to claim 17, wherein a wall of the switchable second outlet pipe has openings in a section of the switchable second outlet pipe at which the resonator pipe surrounds the switchable second outlet pipe.

* * * * *